United States Patent [19]

Eckert et al.

[11] Patent Number: 4,655,184

[45] Date of Patent: Apr. 7, 1987

[54] FUEL INJECTION APPARATUS FOR INTERNAL COMBUSTION ENGINES

[75] Inventors: Konrad Eckert, Stuttgart; Hermann Eisele, Vaihingen-Enz; Helmut Laufer; Max Straubel, both of Stuttgart, all of Fed. Rep. of Germany

[73] Assignee: Robert Bosch GmbH, Stuttgart, Fed. Rep. of Germany

[21] Appl. No.: 382,002

[22] Filed: May 25, 1982

[30] Foreign Application Priority Data

Jun. 12, 1981 [DE] Fed. Rep. of Germany ..... 3123325

[51] Int. Cl.[4] ..... F02M 39/00

[52] U.S. Cl. ..... 123/458; 123/506; 123/494; 123/496

[58] Field of Search ..... 123/506, 458, 357–359, 123/494, 496

[56] References Cited

U.S. PATENT DOCUMENTS

| | | | |
|---|---|---|---|
| 3,598,507 | 8/1971 | Voit | 123/450 |
| 3,661,130 | 5/1972 | Eheim | 123/357 |
| 4,402,290 | 9/1983 | Hofer | 123/359 |
| 4,407,249 | 10/1983 | Eheim | 123/449 |
| 4,462,361 | 7/1984 | Karle et al. | 123/357 |

FOREIGN PATENT DOCUMENTS

| | | | |
|---|---|---|---|
| 0131325 | 11/1978 | Japan | 123/449 |
| 0041438 | 4/1981 | Japan | 123/357 |
| 0075928 | 6/1981 | Japan | 123/357 |
| 1306422 | 2/1973 | United Kingdom | 123/458 |

*Primary Examiner*—Carl Stuart Miller

*Attorney, Agent, or Firm*—Edwin E. Greigg

[57] ABSTRACT

A fuel injection apparatus for internal combustion engines in which beyond a predetermined remaining stroke during the supply stroke of the pump piston, a relief conduit is opened via a control edge. The same control edge closes the relief conduit once again during the intake stroke. During the subsequent effective intake stroke, the quantity of fuel to be injected upon the following compression stroke is metered by means of the electrically actuatable valve. The magnetic valve here is already opened before the closure of the relief conduit by the control edge, so that in the opening phase of the relief conduit, the pump work chamber of the fuel injection apparatus is flushed. In this manner, precise metering of the quantity of fuel to be injected is attained.

20 Claims, 10 Drawing Figures

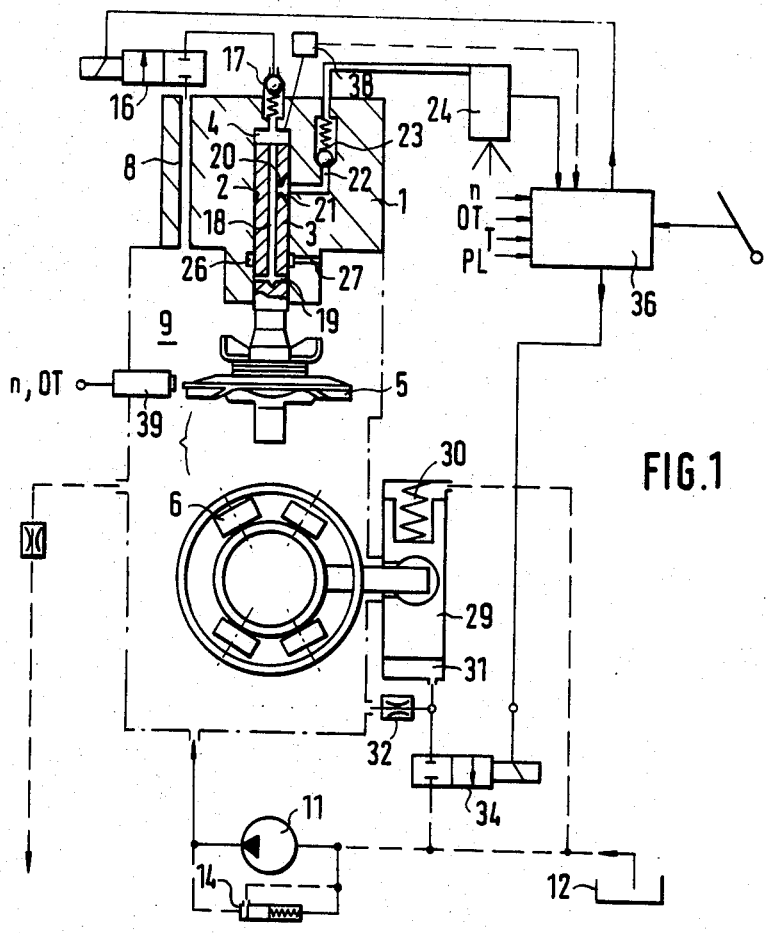
FIG.1
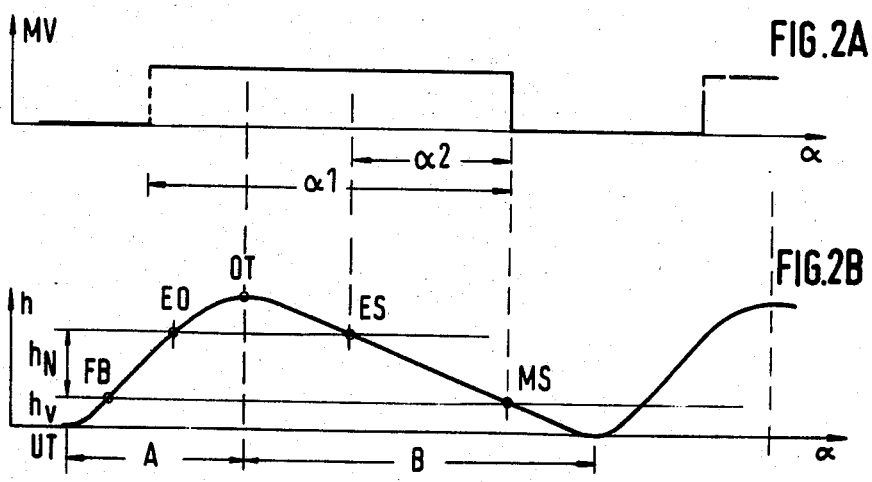
FIG.2A
FIG.2B

FUEL INJECTION APPARATUS FOR INTERNAL COMBUSTION ENGINES

BACKGROUND OF THE INVENTION

The invention relates to a fuel injection apparatus having a work chamber enclosed within a cylinder by a pump piston, the work chamber being connectable with a fuel injection location by at least one supply line, and also being connectable during the piston intake stroke, with a fuel inlet conduit leading to a fuel supply source and having a fuel quantity device which is electrically actuatable by a control unit.

In an injection apparatus of this kind, known from German Offenlegungsschrift No. 19 19 969, the fuel quantity which is to be injected during the supply stroke of the pump piston of an injection pump is metered during the intake stroke of the pump piston by a magnetic valve which is controlled in either a cyclic or an analog manner. The metered quantity is determined by the open period of the magnetic valve, and the open phase of this valve is disposed exclusively within the period of the intake stroke of the pump piston. In this known apparatus, pressure conditions in the work chamber and the valve cross section of the fuel injection pump determine the metered quantity. For precise metering of the fuel injection quantity in this known apparatus, the rpm and the injection instant must be taken into consideration in dimensioning the opening periods of the magnetic valve. The pressure fluctuations in the work chamber during the filling process must also be considered. Further disadvantages are associated with the limited switching speed of the magnetic valve. The two switching processes of the magnetic valve occurring during the intake stroke thus influence the precision of the metered result. The rpm or the injection rpm are also limited by the switching time of the magnetic valve.

In another fuel injection pump, known from German Offenlegungsschrift No. 19 19 707, the limited switching speed of magnetic valves is taken into consideration in that two pumping systems are accommodated in the distributor of this distributor-type pump, each pumping system being supplied with fuel by one magnetic valve. In this manner, a higher pump rpm can be obtained. The cam drive of the pump pistons in this injection pump is also embodied such that the stroke speed of the pump piston during the intake stroke is substantially slower than that during the supply stroke of the pump piston. The magnetic valve of each pumping system of this radial-piston pump is likewise opened exclusively during the intake stroke of the pump piston, and the duration of opening of the magnetic valve determines the metered quantity. Here again, the rpm and the adjustment of injection timing must be taken into consideration in controlling magnetic valves. In designing this pump, the metering cycle of the magnetic valve begins with the intake stroke of the associated pump pistons. An adjustment of injection onset dictates a change in the onset of the intake stroke, so that this intake stroke onset must be furnished precisely in calculating the opening period of the magnetic valve. Dynamic conditions at the switchover point of the pump piston, that is, at the transition from the supply stroke to the intake stroke are also difficult to control. Because of the double pumping system in this fuel injection pump, the apparatus is also very expensive.

OBJECT AND SUMMARY OF THE INVENTION

The fuel injection apparatus according to the invention has the advantage over the prior art that the supply phase, that is, the interval of time in which fuel is fed into the injection lines, is followed by a flushing phase. In this flushing phase, which also encompasses the remaining pressure stroke of the pump piston, the pump work chamber of the fuel injection pump is continuously filled with fuel by way of the electrically actuatable bolt valve and if necessary by way of the relief line, should this relief line lead to the pump work chamber generally present in a fuel injection pump. This fuel is at the supply pressure existing in pump suction chamber or in the fuel supply source. At the instant of closing of the relief conduit, valves to pressure conditions thus prevail, so that with a sufficiently large metering cross section at the valve, the opening period of the valve with respect to the rpm or the opening phase over a predetermined length of the pump piston suction stroke is a precise standard for the injection quantity. Because the electrically actuatable metering valve is already opened during the flushing period, for instance, following the supply stroke of the pump piston, the closing instant of the relief conduit advantageously determines the metering onset by means of the control edge. This closure takes place without the time loss which must be calculated in the case of the magnetic valve, so that the metering quantity can be further influenced only by the closing time of the valve at the end of the metering phase.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 is a fundamental illustration of the exemplary embodiment;

FIG. 2*a* is a diagram showing the switching time of the metering valve plotted over the rotary angle;

FIG. 2*b* shows the course of the pump piston stroke as associated with the switching times of the metering valve;

DESCRIPTION OF THE EXEMPLARY EMBODIMENT

Figure 3:
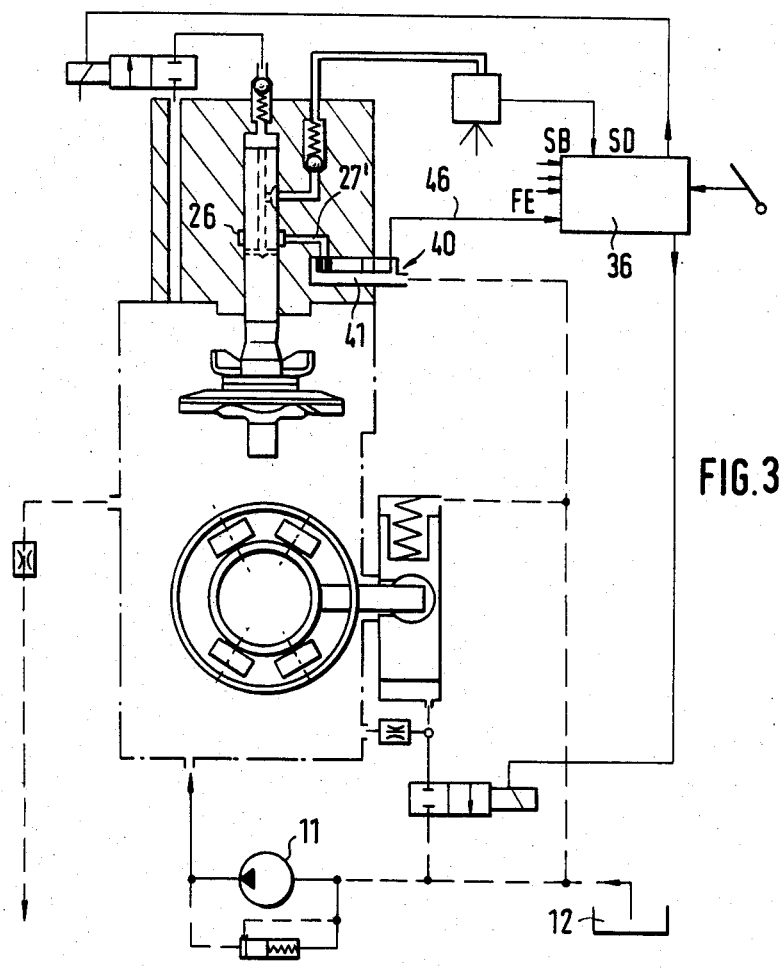
FIG. 3 is a modification of the exemplary embodiment of FIG. 1 having a measuring device for detecting the control time of the relief conduit.

In the exemplary embodiment shown in FIG. 1, a bore 2 is provided in the pump housing 1 and a pump piston 3 encloses a pump work chamber 4 in this bore 2. The pump piston is driven by means not further shown via a cam plate 5 which rolls on a roller ring 6, thus executing a reciprocal pumping movement with an intake stroke and a supply stroke at the time of the rotary movement. The supply of fuel to the pump work chamber is effected via a fuel inlet conduit 8, which leads from a pump suction chamber 9. This suction chamber is supplied with fuel by means of a fuel supply pump 11 from a fuel container 12, and the pressure in the fuel suction chamber 9 is established with the aid of a pressure control valve 14, which is switched in parallel with the supply pump 11.

An electrically actuatable valve 16, which may be a magnetic valve, is inserted as a fuel quantity metering device in the fuel inlet conduit. Downstream of this valve a check valve 17 is also provided which opens in the direction of the fuel inflow into the pump work chamber 4. A blind bore 18 disposed in the pump piston 3 leads away from the pump work chamber 4 and a radial bore 19 leads outward from the end of this blind bore 18. A further radial bore 20 connects the blind bore 18 with a distributor groove 21, by means of which, upon the rotation of the pump piston and during its supply stroke, supply lines 22 are connected in sequence with the work chamber 4. The supply lines 22 are distributed on the circumference of the bore in accordance with the number of cylinders of the associated engine to be supplied with fuel, and each supply line 22 contain one relief valve 23 and is each connected with one injection valve 24. An annular groove 26 is further provided in the wall of the bore 2 and communicates via at least one bore 27 with the pump suction chamber 9. The annular groove 26 is disposed such that when the radial bore 19 in the pump piston 3 is opened beyond a maximal supply stroke, the fuel supplied beyond this point in the course of the further stroke of the pump piston 3 flows into the suction chamber 9 by way of the blind bore 18 acting as a relief conduit, the radial bore 19 and the bore 27, thus interrupting the pressurized supply into the supply line 22.

In order to vary the instant of injection, an injection adjustment piston 29 is provided, which is coupled with the cam ring 5 and is adjustable counter to the force of a spring 30. The injection adjustment piston 29 encloses a pressure chamber 31 which communicates via a throttle 32 with the pump suction chamber 9 and is thus exposed to the rpm-dependent pressure in the pump suction chamber 9. In accordance with this rpm-dependent pressure, the injection instant is adjusted toward "early" with increasing rpm by means of rotating the cam ring 5 with the aid of the injection adjustment piston 29. In order to influence the injection adjustment time, the pressure chamber 31 further communicates via a magnetic valve 34 with the intake side of the supply pump 11, and it can be relieved with the aid of this valve 34. The magnetic valve 34 is controlled by a control unit 36, which furthermore serves to control the electrically actuatable valve 16 in the fuel inlet conduit. To this end, the control unit 36 operates in accordance with the parameters which are to be taken into consideration in dimensioning and time control of the fuel injection quantity. The control unit may include at least one performance graph, for instance, in which set-point valves for the quantity of fuel to be injected are contained either in indirect or direct form. In a manner known per se, the parameters to be taken into consideration may be the rpm, temperature, the air pressure, and the load. Further parameters intended in particular for triggering the magnetic valve 32 may be signals of a needle stroke transducer in the injection valve 24 for ascertaining the actual onset of injection and the actual fuel injection duration. Alternatively, control signals for ascertaining the onset of supply or the duration of supply can be used by way of a pressure transducer 38 which is disposed in a suitable manner on the high-pressure side of the fuel injection pump. In order to ascertain the stroke position of the pump piston and/or its rpm, a transducer 39 may be provided, for instance in the form of an inductive transducer on the cam plate 5.

The mode of operation of the fuel injection device shown in FIG. 1 will now be explained, referring to the diagrams of FIGS. 2*a* and 2*b*. FIG. 2*b* shows the curve of the rise or travel h of the pump piston 3 plotted over the rotary angle $\alpha$. By means of the appropriate embodiment of the cam plate 5, it is hereby ascertained that the variation in the stroke per rotary angle $\alpha$ is substantially greater during the compression or supply stroke of the pump piston 3 than is the stroke change during the intake stroke of the pump piston 3. This curved segment B of the curve for the piston rise h has a very flat course and is linear except for the boundary area at the transitional points of the pump piston 3. The pressure stroke segment A of the curve in FIG. 2*b* is subdivided into three partial segments. Between bottom dead center UT of the pump piston 3 at the beginning of the pressure stroke up to point FB, the fuel present in the pump work chamber 4 is compressed until the supply pressure which causes an opening of the nozzle 24 has been attained. The second portion of the curve now extends between FB and EO. In this range, fuel is fed into the supply conduit 24. The check valve 17, possibly reinforced by the spring built into the line at that point, is closed for the time being as a result of the supply pressure. The electrically actuatable valve 16, here embodied as a slide valve, is thereby relieved of pressure. Upon attaining point EO of the piston rise curve, the radial bore 19 is brought into communication with the annular groove 26, so that the pressure chamber 4 is relieved in favor of the suction chamber 9. The remaining quantity of fuel positively displaced by the pump piston flows away to the suction chamber. This is effected in the range between the opening of the relief conduit (EO) and top dead center (OT). The magnetic valve 16 is opened upon the attainment of the point OT at the latest. This opening can occur earlier, however, because during the pressure stroke the fuel inlet conduit 8 is closed by the check valve 17. In the range between OT and the closing point of the relief conduit ES, fuel is now aspirated over the wide opening cross section of the valve 16. The pressure equalization in the pump work chamber 4 can furthermore be effected also by way of the relief conduit 18, the radial bore 19 and the bore 27. In the range between EO and ES, it is assured that the pressure in the work chamber 4 is equalized, and the work chamber 4 is continuously filled and flushed. Beyond point ES, the intake stroke of the pump piston 3 begins. Fuel is aspirated until the closure of the magnetic valve 16 at MS. The effective length of the intake stroke $\alpha 2$ is thus determined on the one hand by the geometric embodiment of the fuel injection pump, or by the position of the control edge defining the annular groove 26, and on the other hand by the switching time of the magnetic valve 16. The switching times of the magnetic valve 16 are plotted in FIG. 2*a*, and $\alpha 1$ indicates the total opening period of the magnetic valve, while $\alpha 2$ indicates the time effective for the metering.

Since the magnetic valve 16 can already be opened substantially earlier than the onset of the actual effective intake stroke, and since furthermore a flushing phase (EO-ES) is located between the effective supply stroke and the effective intake stroke of the pump piston, the instant of injection within the possible range for adjustment of injection timing needs no longer to be taken into consideration in the opening of the magnetic valve 16. The control of fuel metering does not influence or hinder the opportunities for adjustment of injection timing. Because of the flat cam course during the intake stroke, the advantage is further attained that the pump piston is also capable of continuously following the cam, even at high rpm, without causing the pump piston 3 to descend within the effective length of the intake stroke and thus influencing the quantity of aspirated fuel.

In an advantageous manner, the rising inclination of the cam over the possible length of the effective intake stroke is embodied as linear, which has particularly advantageous results in making corrections. Basically, however, the manner of metering is not dependent on the linearity of the cam rise curve, although it does make it easier to effect precise metering. By fixing the effective intake stroke length, a very good metering precision of the quantity of fuel to be metered is attained. In the simplest case, the effective intake stroke length for the metering can be controlled directly, without requiring feedback of the actual quantity of fuel injected. Very good control results are attained if the actual fuel injection quantity is detected in a manner known per se by means of the control unit 36 and compared in a comparison apparatus of the control unit 36 with a set-point fuel quantity signal formed in the control unit 36. As mentioned initially, the actual fuel quantity can be ascertained by means of a needle stroke transducer or by means of an appropriately evaluated pressure signal of the pressure transducer 38. The set-point fuel quantity is formed on the basis of the parameters mentioned initially, with the load being the guide variable. The actual opening time of the magnetic valve 16 is then corrected in accordance with the resultant comparison if the actual fuel quantity deviates from the set point value. The basic opening duration signal of the valve 16 is formed in accordance with the set-point fuel quantity signal.

Figure 4:
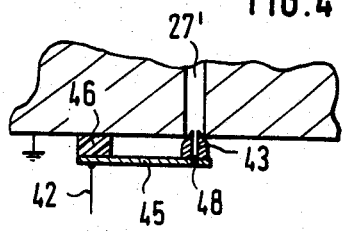
FIG. 4 is an enlarged illustration of the measuring device as shown in FIG. 3 for detecting the switching times of the relief conduit.

In order to detect precisely the rising point at which the relief conduit 19 is again closed (ES), a transducer 40 is advantageously provided as shown in FIG. 3. Otherwise the fuel injection apparatus of FIG. 3 corresponds to that in FIG. 1. In FIG. 4 a transducer of this kind is shown on an enlarged scale. In this modification of the fuel injection apparatus, the bore 27' likewise leads away from the annular groove 26 and by way of the transducer 40, with a complete pressure relief, to the intake side of the fuel supply pump 11 or to the fuel supply container 12. The transducer 40 is located within a pressure-relieved chamber 41. The outlet of the bore 27' into the pressure-relieved chamber 41 is controlled by a valve closing member 43, which is secured on a leaf spring 45. The leaf spring 45 is attached to the pump housing on the other end by way of an insulating piece 46 which at the same time represents the connection to ground. From the leaf spring 45, which in a different form of embodiment may also be a diaphragm or a spider in a suitable embodiment, an electric line 42 leads to the control unit 36. Furthermore, a throttle bore 48 is provided co-axially with the axis of the bore 27' in the valve closing element, by way of which the bore 27' communicates continuously with the chamber 41, even when the valve closing member 43 is in the closed position. Despite the throttle bore 48, a pressure is capable of building up in the bore 27' as long as fuel is flowing out of the pump chamber 4 by way of the blind bore 18. This is the case as long as the radial bore 19 is in communication with the annular groove 26 and as long as the magnetic valve 16 is open. For the range of the intake stroke B between OT and ES, this condition exists. Under the pressure being established thereby, the valve closing element 43 rises from its seat at the bore 27' and thus interrupts the flow of current to ground. However, as soon as communication between the radial bore 19 and the bore 27' is again interrupted in the course of the intake stroke of the stroke piston 3, the valve closing member 43 returns to its seat and closes the current circuit. This is the signal that the effective intake stroke has begun. The signal is appropriately processed in the control unit 36, which may advantageously be effected with the aid of an integrating device.

With the closing signal of the transducer 14, the integrating device is set, and as soon as the output value of the integrating device has attained the set-point value for the fuel quantity provided by the control unit 36, a switching signal is emitted from a comparison device for both values to the magnetic valve 16 in order to close the fuel inlet conduit 8. So that the switching time of the valve 16 will be dependent purely on the stroke length, the operating time of the integrator must be corrected during integration by an integration time constant adapted to the rpm. This can be done with known methods, in that on the one hand the design of the integrator itself is made rpm-dependent in an analog fashion or on the other hand in that the integrator integrates in constant integration steps with an rpm-dependent frequency.

In another embodiment, a top dead center signal attained with the aid of the transducer 39 and the closing signal emitted by the transducer 40 can be used to generate a correction signal which corrects the opening phase of the valve 16 switched in synchronism with the rpm.

The embodiment of the transducer 40 according to FIGS. 3 and 4 also permits the formation of an opening signal for opening the bore 27'. It would be possible, for instance, to form an opening signal with the valve 16 with such an opening signal for the bore 27'.

Figure 5:
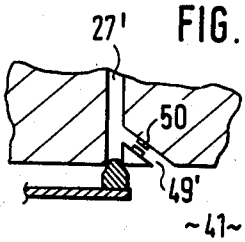
FIG. 5 is a first modified form of the device according to FIG. 4.
Figure 6:
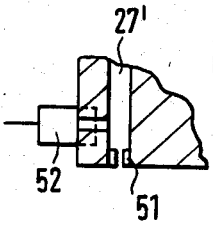
FIG. 6 is a second modified form of the device according to FIG. 4.

In FIG. 5, an alternative realization of the transducer 40 for opening or closing the bore 27' is shown. The throttle bore 48 provided in the closing element 43 of FIG. 4 is provided in this realization in the form of a throttle 50 in a branching conduit 49' which leads to the pressure-relief chamber 41. In the realization shown in FIG. 6, a throttle 51 is provided at the outlet of the bore 27' into the pressure-relief chamber 41, and a pressure transducer 52 is disposed upstream of the throttle 51 in the wall of the bore 27'. The pressure signal emitted by this transducer 52 is preferably converted via a threshold switch into the closing signal or the opening signal.

Figure 7:
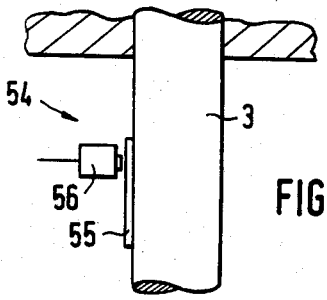
FIG. 7 is a device for ascertaining the stroke movement of the pump piston.

Instead of the above-described rpm-compensated integration, it is also possible to associate a stroke transducer 54 with the pump piston, as shown in FIG. 7. To the end, a pulse generator 55 is provided with the pump piston 3 parallel to the pump piston axis, and a receiver, for instance an inductive receiver 56, is associated with it. The pulse generator may be made up of magnetized elements located one behind the other or it may be embodied as a toothed strip. Such pulse transducers are known in principle and need be described no further at this point. The signals emitted by the transducer 56 are then integrated upward in the integrator, and the rpm or stroke speed of the pump piston need no longer be taken into consideration.

Figure 8:
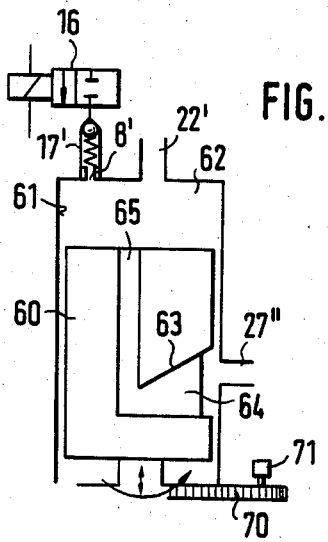
FIG. 8 is modification of the form of embodiment of FIG. 1 with an altered injection timing adjustment device.

The principle applied in the embodiments described above, of the fuel injection apparatus and its modifications can equally well be applied to a fuel injection pump which is designed as a series-type pump. FIG. 8 shows a pump piston 60 as one of the pump pistons of such a series pump. This pump piston 60 is capable of reciprocation and may simultaneously be rotated as well within a cylinder 61 for the purpose of aspirating and supplying fuel. It encloses a pump work chamber 62 in the pump cylinder 61, from which a fuel injection nozzle is supplied with fuel. A fuel inlet conduit 8', which as in FIG. 1 includes a check valve 17' and an electrically actuatable metering valve 16, also discharges into the work chambers 62. In order to attain a flushing phase in the manner described above, the pump piston has an oblique control edge 63, which defines a partial annular groove 64 in the jacket face of the pump piston 60. The partial annular groove 64 communicates via a longitudinal groove 65 or via a corresponding bore with the pump work chamber 62. The oblique control edge 63 cooperates with a relief conduit 27'', by way of which the fuel positively displaced out of the work chamber is capable of flowing out during a remaining stroke distance of the pump piston 60. Depending on the rotary position of the pump piston, established by means of a rack 70, for instance, the relief conduit 27'' is opened or closed again earlier or later. Thus, an adjustment in injection, or in other words a variable end to fuel supply, is attained by means of the rotary position of the piston 60. In order to detect the onset of the effective intake stroke, it is relatively simple here to use a transducer 71 which detects the rotary position of the pump piston 60 or engages the rack 70, and its correction signal is taken into consideration by means of a corresponding control unit in forming the opening pulse of the electrically actuatable valve 16.

Figure 9:
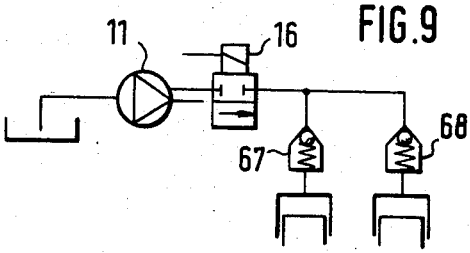
FIG. 9 is a modification of the exemplary embodiment having the supply of several cylinders effected by a magnetic valve.

As FIG. 9, it is possible also to supply a multiplicity of pistons with fuel via one electrically actuatable metering valve 16. One check valve 67, 68 is advantageously associated with each individual pump piston. The condition for an embodiment of this kind is that this trailing edge of the cam, that is, the course of the pump piston stroke during the effective intake stroke, is the same for both pistons.

The foregoing relates to a preferred exemplary embodiment of the invention, it being understood that other embodiments and variance thereof are possible within the spirit and scope of the invention, the latter being defined by the dependent claims.

What is claimed and desired to be secured by Letters Patent of the United States is:

1. In a fuel injection apparatus having at least one pump work chamber enclosed within a cylinder in a housing by a pump piston, said pump work chamber being connectable via at least one supply line with a fuel injection location said pump work chamber being connectable with a fuel inlet conduit having a fuel quantity metering device which controls fuel flow from a fuel supply source to said pump work chamber, the improvement wherein:

said pump work chamber being connected continuously to said fuel inlet conduit a relief conduit having a flowthrough cross section that leads away from said pump work chamber, the flowthrough cross section of said relief conduit being openable upon a preset pressure stroke of said pump piston during a remaining stroke thereof by a control edge guided in synchronism with the movement of the pump piston and closeable once again beyond an intake stroke corresponding to said remaining stroke of the piston;

said fuel quantity metering device is embodied as an electrically actuatable valve, which can be brought into an open position or closed position depending upon triggering and is switchable by a control unit in such a manner that said fuel quantity metering device is already opened prior to the closure of the relief conduit during the intake stroke of the pump piston and is closed after a metering pump intake stroke of the pump piston following the closure of the relief conduit depending upon the fuel quantity to be injected; and a contoured track that periodically actuates said pump piston; said contoured track is embodied such that a change in stroke of said pump piston per unit of movement of said contoured track during the intake stroke of said pump piston is substantially less than that during the compression stroke of the pump piston.

2. A fuel injection apparatus as defined by claim 1, characterized in that the curved track is embodied such that the change in stroke of the pump piston per unit of movement (rotary angle) of the curved track is constant in the vicinity of the effective intake stroke of the pump piston.

3. A fuel injection apparatus as defined by claim 1, characterized in that the control unit is connected with a transducer for the actual fuel injection quantity, whose output value is compared in a comparison device in the control unit with the set-point fuel quantity signal, and in accordance with the output signal of the comparator device a correction signal is formed for an opening duration signal of the valve formed in accordance with the set-point value.

4. A fuel injection apparatus as defined by claim 3, characterized in that the control unit is connected with a transducer, which emits a signal ascertaining the closure of the relief conduit, and that a correction signal can be generated in accordance with the closure signal, in accordance with which correction signal the position of the opening phase of the valve is variable.

5. A fuel injection apparatus as defined by claim 3, characterized in that a pressure transducer detecting the supply phase is provided as the actual fuel injection quantity transducer.

6. A fuel injection apparatus as defined by claim 3, characterized in that a transducer detecting the needle stroke of the injection nozzle is provided as the actual fuel quantity transducer.

7. A fuel injection apparatus as defined by claim 1, characterized in that the control unit is connected with a transducer which emits a signal characterizing the closure of the relief conduit or the onset of the effective intake stroke length, by means of which an opening signal for the valve determining the effective intake stroke length is set, the length of the opening duration signal corresponding to the respective set-point value of the fuel metering quantity.

8. A fuel injection apparatus as defined by claim 7, characterized in that an integrator is setable by means of the closure signal, the integration value thereof being compared with a set-point value in a comparison device in the control unit, and that upon the attainment of the set-point value a switching signal is transmitted to the valve by the comparison device.

9. A fuel injection apparatus as defined by claim 8 characterized in that the integration constant of the integrator dependent on the rpm.

10. A fuel injection apparatus as defined by claim 9, characterized in that, in the rpm-dependent cycle, the integrator adds constant integration steps.

11. A fuel injection apparatus as defined by claim 1, characterized that for the formation of the signal controlling the valve, the control unit is connected with a stroke length transducer.

12. A fuel injection apparatus as defined by claim 11, characterized in that the stroke length transducer generates equally spaced pulses along the stroke of the pump piston and is connected with an integrator, which is settable by means of a closure signal of the relief conduit and whose integration value is compared in a comparison device of the control unit with a set-point value wherein upon attainment of the set-point value a switching signal for the valve is generated.

13. A fuel injection apparatus as defined by claim 4 characterized in that in the relief conduit leading to a chamber having lower pressure, a throttle is disposed downstream of the control edge and a pressure transducer is provided, which is exposed to the pressure in the relief line upstream of the throttle restriction and that a signal for the opening status and the closing status of the relief conduit can be formed on the basis of the output signal of the pressure transducer.

14. A fuel injection apparatus as defined by claim 13, characterized in that the pressure transducer comprises a spring which is electrically insulated relative to its fastening point and has a closing element embodied as the closure device of the relief line, the closure element being pressed against the outlet opening of the relief line by the prestressing of the spring.

15. A fuel injection apparatus as defined by claim 13, characterized in that in the area where the closure element overlaps the outlet opening of the relief line the throttle is disposed as a passageway for the bore passing through the closure element.

16. A fuel injection apparatus as defined by claim 1, characterized in that for the purpose of adjusting the injection timing, an apparatus for adjusting the pump piston rotary position relative to the pump piston drive is provided.

17. A fuel injection apparatus as defined by claim 1, characterized in that the control edge extends obliquely and the control edge is adjustable transversely for the purpose of adjusting injection timing,.

18. A fuel injection apparatus as defined by claim 17 characterized in that a position transducer is connected with an adjusting device for the rotary position of the control edge, by means of which position transducer a signal can be derived for the detection of the effective intake stroke onset.

19. A fuel injection apparatus as defined by claim 1, charcterized in that a check valve which opens in the direction of the work chamber is disposed between the electrically actuatable valve in the fuel inlet conduit and the work chamber of the fuel injection pump.

20. A fuel injection apparatus as defined by claim 19, characterized in that the valve closing member of the electrically actuatable valve can be kept in the closed position when the valve has no current flowing through it by means of the supply pressure in the work chamber of the fuel injection pump.

* * * * *